US005536222A

United States Patent [19]

Banda et al.

[11] Patent Number: 5,536,222

[45] Date of Patent: Jul. 16, 1996

[54] UPPER BODY EXERCISE DEVICE

[76] Inventors: José A. Banda, 10755 Meadowglen La., Apt. 259, Houston, Tex. 77042; James R. Langston, 5210 Bailey, Pearland, Tex. 77584

[21] Appl. No.: 482,325

[22] Filed: Jun. 7, 1995

[51] Int. Cl.[6] ..... A63B 1/00

[52] U.S. Cl. ..... 482/38; 482/17; 482/148

[58] Field of Search ..... 482/17, 40, 104, 482/44, 148

[56] References Cited

U.S. PATENT DOCUMENTS

| | | | |
|---|---|---|---|
| 201,328 | 3/1878 | Chamberlin | 482/17 |
| 3,107,091 | 10/1963 | Jenkins | 482/17 |
| 3,118,668 | 1/1964 | Callahan | 482/104 |
| 3,294,400 | 12/1966 | Goldstein | 482/17 |
| 4,201,380 | 6/1980 | Birch | 482/104 |
| 4,302,009 | 11/1981 | Johnson | 482/104 |
| 4,958,833 | 9/1990 | Stater | 482/104 |
| 5,290,213 | 3/1994 | Sheikowitz | 482/104 |
| 5,334,121 | 8/1994 | McPhilomy | 422/17 |

*Primary Examiner*—Lynne A. Reichard
*Attorney, Agent, or Firm*—Buskop Law Group; Cynthia G. Seal

[57] ABSTRACT

An exercise device designed to be used with a rod or a bar. The exercise device is lightweight and detachable. It does not require clamps or screws to secure it to a tabletop. The exercise device is also portable.

22 Claims, 2 Drawing Sheets

UPPER BODY EXERCISE DEVICE

BACKGROUND OF THE INVENTION

This invention relates to an exercise device designed to be used with a rod or bar. In another aspect, it relates to a novel construction that allows the device to be used without clamps or screws.

Other exercise devices designed to be used with a rod or a bar present several problems. These devices require clamps or screws to hold the device in place on a tabletop. The requirement of a clamp creates a risk to the user if the clamp is not installed properly or if the clamp is defective. The requirement of a clamp or screws greatly limits the portability of the device. Clamps or screws may also cause permanent damage to the table. The overall size of prior exercise devices contributes to the device being cumbersome and difficult to transport easily. An exercise device that is lightweight and portable is highly desirable.

The present invention remedies the deficiencies of the prior art. This invention does not require clamps or screws. The present invention is made of lightweight material and has a narrow construction. The device may be taken apart easily. All of these factors make the present invention very portable and easy to use.

OBJECTS OF THE INVENTION

It is one object of this invention to provide an exercise device that does not require clamps or screws.

It is another object of this invention to provide an exercise device of lightweight construction.

It is another object of this invention to provide an exercise device that is detachable and easily portable.

SUMMARY OF THE INVENTION

In the present invention there is provided an exercise device having a first upright leg, a second upright leg positioned generally parallel to the first upright leg. The first upright leg and the second upright leg are attached to the base. The upright legs extend generally normal to the base. There is a plane defined by the first upright leg and the second upright leg and a longitudinal axis defined between the first upright leg and the second upright leg. The first upright leg and the second upright leg form a plurality of longitudinally spaced open slots for positioning a rod. The rod extends between the first upright leg and the second upright leg. The slots in each upright leg are aligned in longitudinally spaced pairs. Each pair includes one slot in one of the upright legs, and another transversely aligned slot in the other upright leg. The base has a first platform portion and a second platform portion. The first platform portion extends away from the plane defined by the first upright leg and the second upright leg in a first direction. The second platform portion extends away from the plane defined by the first upright leg and the second upright leg in an opposite direction. This construction allows for the exercise device to be used without clamps or screws.

In another embodiment of the invention, there is provided a method for assembling an exercise device. The method comprises providing a first upright leg, a second upright leg, and a base. The first leg and the second leg have a longitudinal axis and the base has a first side and a second side. The base has a first means for receiving the first leg positioned on the first side and a second means for receiving the second leg positioned on the first side. The first upright leg and the second upright leg form a plurality of longitudinally spaced open slots for positioning a rod as described above. The base has a first platform portion and a second platform portion. The first portion extends away from the first means for receiving the first leg and the second means for receiving the second leg in a first direction. The second portion extends away from the first means for receiving the first leg and the second means for receiving the second leg in an opposite direction. The first upright leg is positioned in the first means for receiving the first upright leg. Then the second upright leg is positioned in the second means for receiving the second upright leg on the base. The first and second upright legs lie in a plane normal to the base. A longitudinal axis lies between the first upright leg and the second upright leg and the first upright leg and the second upright leg lie in a plane parallel to one another. This type of construction allows for the exercise device to be taken apart and transported easily.

In another embodiment of the invention there is provided a method for exercising. The method comprises providing an execise device as described above and an exercise bar. The exercise device is placed on a table. The exercise bar is generally cylindrical. The exercise bar is placed in one of the slots in the first upright leg and the transversely aligned slot in the second upright leg. Then the exercise bar is moved from a first slot on the first upright leg to a second slot on the first upright leg. Then the exercise bar is moved from a first slot on the second upright leg to a second slot on the second upright leg. The present invention is much easier to assemble and use because it is essentially free standing and does not require clamps or screws.

DETAILED DESCRIPTION OF THE PREFERRED EMBODIMENTS

Figure 1:
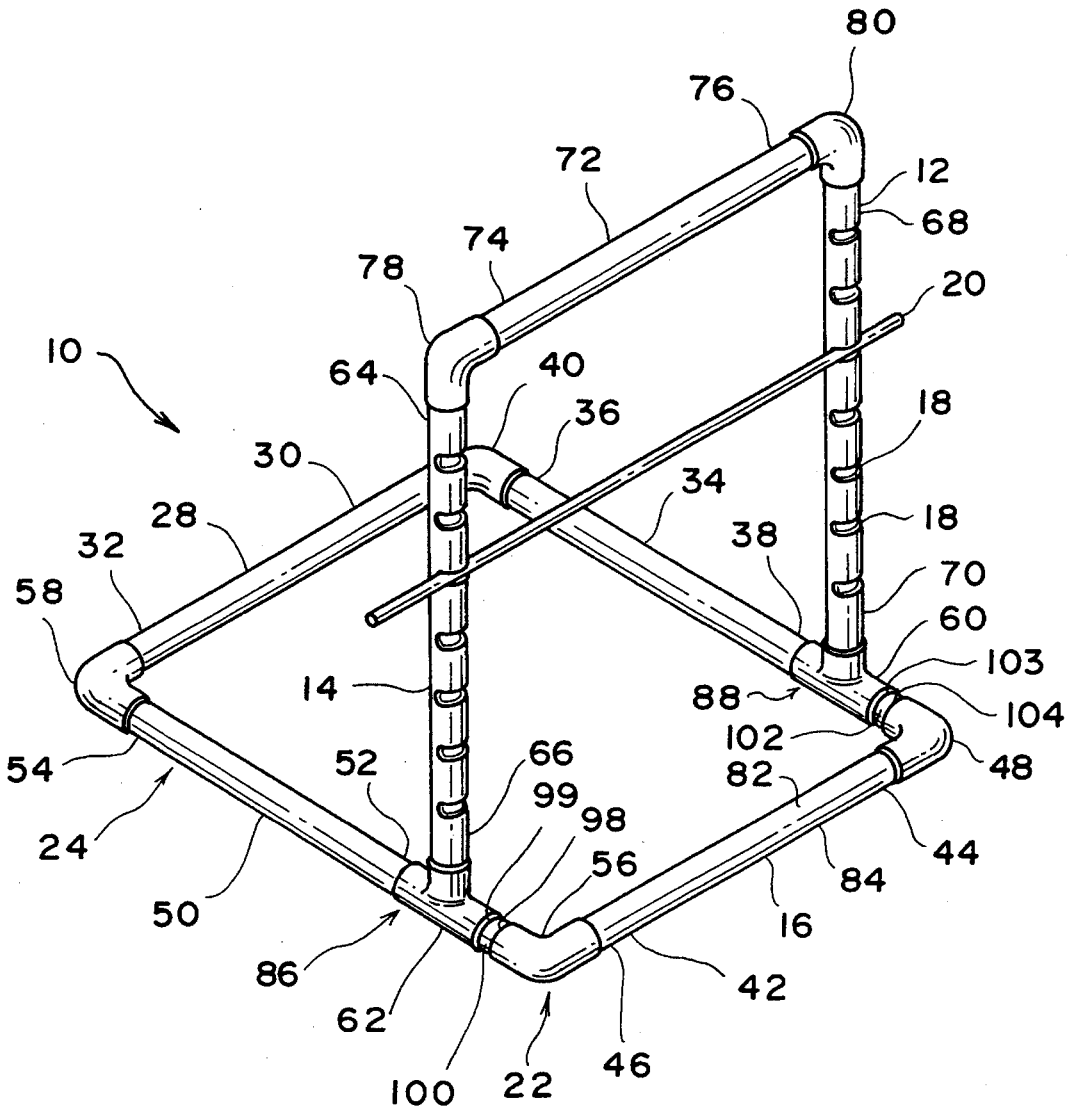
FIG. 1 is a pictorial view of an exercise device shown with an exercise bar.
Figure 2:
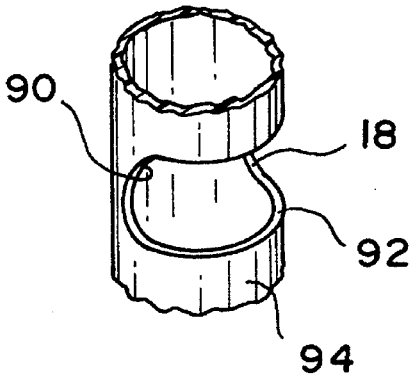
FIG. 2 is a side view of a slot on one of the upright legs of the exercise device.
Figure 3:
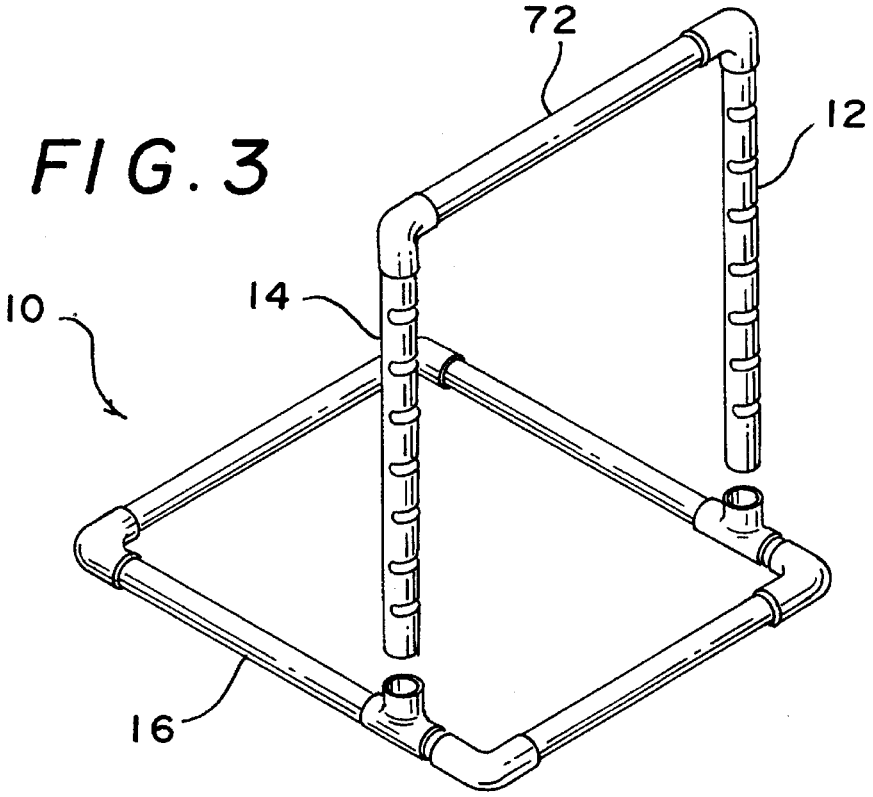
FIG. 3 is a pictorial view of an exercise device showing the upright legs detached from the base.
Figure 4:
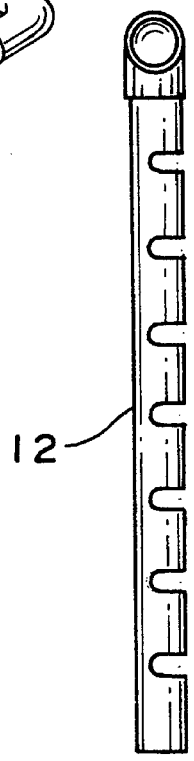
FIG. 4 is a side view of one of the upright legs.

In one embodiment of the invention there is provided an exercise device 10 having a first upright leg 12, a second upright leg 14 positioned generally parallel to the first upright leg 12. The first upright leg 12 and the second upright leg 14 are attached to the base 16. The upright legs extend generally normal to the base 16. There is a plane defined by the first upright leg 12 and the second upright leg 14 and a longitudinal axis defined between the first upright leg 12 and the second upright leg 14. Preferably the base 16 has an outside perimeter which is generally rectangular in shape and lies in a plane which is normal to the plane defined by the first upright leg 12 and the second upright leg 14. The first upright leg 12 and the second upright leg 14 form a plurality of longitudinally spaced open slots 18 for positioning a rod 20. The rod 20 extends between the first upright leg 12 and the second upright leg 14. The slots 18 in each upright leg are aligned in longitudinally spaced pairs. Each pair includes one slot in one of the upright legs, and another transversely aligned slot in the other upright leg. The base 16 has a first platform portion 22 and a second platform portion 24. The first platform portion 22 extends away from the plane defined by the first upright leg 12 and the second upright leg 14 in a first direction. The second platform portion 24 extends away from the plane defined by the first upright leg 12 and the second upright leg 14 in an opposite direction.

Preferably, the slots 18 have an upper surface 90 and a lower surface 92. The lower surface 92 of the slots 18 slant downward from the outer surface 94 of the device 10 toward the longitudinal axis. The lower surface 92 forms an angle with the horizontal plane.

In a preferred embodiment, the base 16 has a first mass and the first upright leg 12 and second upright leg 14 have a second mass, where the first mass is greater than the second mass. Preferably, the base 16 defines a cavity containing sand, ball bearings, water, or weighted gels. It is preferred that the first platform portion 22 extend away from the plane defined by the first upright leg 12 and the second upright leg 14 a first distance and the second platform portion 24 extend away from the plane defined by the first upright leg 12 and the second upright leg 14 a second distance. In this embodiment, the first distance is greater than the second distance.

In another preferred embodiment, the base 16 of the exercise device 10 is formed from PVC pipe having a diameter in the range of from about 1 inch to about 4 inches, a width in the range of from about 11 inches to about 20 inches, and a length in the range of from about 16 inches to about 24 inches. Preferably, the PVC pipe has a 2 inch diameter, the base 16 has a width of 12 inches and a length of 18 inches and the first upright leg 12 and the second upright leg 14 are between 18 and 22 inches high. The device 10 could also be fabricated from a wood, graphite composite, laminated wood, or laminated metal. Furthermore, the device 10 could have a pigment deposited on the outer surface 94.

In a preferred embodiment, the base 16 comprises a first pipe section 28, a second pipe section 34, a third pipe section 42, a fourth pipe section 50, a fifth pipe section 98 and a sixth pipe section 102. The first pipe section 28 has a first end 30 and a second end 32 and the second pipe section 34 has a first end 36 and a second end 38. The first end 30 of the first pipe section 28 is connected to the first end 36 of the second pipe section 34 by a first elbow connector 40. The third pipe section 42 has a first end 44 and a second end 46. The fourth pipe section 50 has a first end 52 and a second end 54. The second end 32 of said first pipe section is connected to the second end 54 of the fourth pipe section 50 by a second elbow connector 58. The fifth pipe section 98 has a first end 100 and a second end 99. The sixth pipe section 102 has a first end 104 and a second end 103. The first end 44 of said third pipe section 42 is connected to said first end 104 of said sixth pipe section 102 by a third elbow connector 48. The second end 46 of said third pipe section 42 is connected to the first end 100 of the fifth pipe section 98 by a fourth elbow connector 56. The second end 38 of the second pipe 34 section is connected to the second end 103 of the sixth pipe section 102 by a first T-connector 60 extending generally normal from the base 16. The first end 52 of the fourth pipe section 50 is connected to the second end 99 of the fifth pipe section 98 by a second T-connector 62 extending generally normal from the base 16.

The first upright leg 14 has a first end 64 and a second end 66, and the second upright leg 12 has a first end 68 and a second end 70. There is a cross bar 72 having a first end 74 and a second end 76. The first end 64 of the first upright leg 14 is connected to the first end 74 of the cross bar 72 by a fifth elbow connector 78. The second end 76 of the cross bar 72 is connected to the first end 68 of the second upright leg 12 by a sixth elbow connector 80. The second end 66 of the first upright leg 14 is connected to the base 16 by the first T-connector 60 and the second end 70 of the second upright leg 12 is connected to the base 16 by the second T-connector 62.

In another preferred embodiment, the first upright leg 14 has a first end 64 and a second end 66 and the second upright leg 12 has a first end 68 and a second end 70. The first end of 64 the first upright leg 14 is connected to the first end 68 of the second upright leg 12 by a cross bar 72 positioned generally normal to the upright legs 12 and 14 and generally parallel to the base 16.

In another embodiment of the invention, there is provided a method for assembling an exercise device 10. The method comprises providing a first upright leg 14, a second upright leg 12, and a base 16. The first upright leg 14 and the second upright leg 12 have a longitudinal axis and the base 16 has a first side 82 and a second side 84. The base 16 has a first means for receiving the first upright leg 86 positioned on the first side 82 and a second means for receiving the second upright leg 88 positioned on the first side 82. The first upright leg 14 and the second upright leg 12 form a plurality of longitudinally spaced open slots 18 for positioning a rod 20 as described above. The base 16 has a first platform portion 22 and a second platform portion 24. The first platform portion 22 extends away from the first means for receiving the first upright leg 86 and the second means for receiving the second upright leg 88 in a first direction. The second platform portion 24 extends away from the first means for receiving the first upright leg 86 and the second means for receiving the second upright leg 88 in an opposite direction. The first upright leg 14 is positioned in the first means for receiving the first upright leg 86. Then the second upright leg 12 is positioned in the second means for receiving the second upright leg 88 on the base 16. The first upright leg 14 and second upright leg 12 lie in a plane normal to the base 16. A longitudinal axis lies between the first upright leg 14 and the second upright leg 12 and the first upright leg 14 and the second upright leg 12 lie in a plane parallel to one another.

In another embodiment of the invention there is provided a method for exercising. The method comprises providing an execise device 10 as described above and an exercise bar 20. The exercise device 10 is placed on a table. The exercise bar 20 is generally cylindrical. Preferably, the exercise bar 20 is weighted internally. The exercise bar 20 is placed in a first slot on the first upright leg 14 and the transversely aligned slot in the second upright leg 12. Then the exercise bar 20 is moved from the first slot on the first upright leg 14 to a second slot on the first upright leg 14 and the transversely aligned slot in the second upright leg 12.

What is claimed is:

1. An exercise device having a first upright leg, a second upright leg positioned generally parallel to the first upright leg, and a base, wherein the first upright leg and the second upright leg are attached to said base and extend generally normal to said base, a plane being defined by the first upright leg and the second upright leg and a longitudinal axis being defined between the first upright leg and the second upright leg, wherein the first upright leg and the second upright leg form a plurality of longitudinally spaced open slots for positioning a rod extending between the first upright leg and the second upright leg, with the slots in each upright leg being aligned in longitudinally spaced pairs, with each pair including one slot in one of the upright legs, and another transversely aligned slot in the other of the upright legs, said base having a first platform portion and a second platform portion, wherein said first platform portion extends away from the plane defined by the first upright leg and the second upright leg in a first direction and said second platform portion extends away from the plane defined by the first upright leg and the second upright leg in an opposite direction, wherein the base further defines a cavity and said cavity contains a material from the group consisting of: sand, ball bearings, water, and weighted gels.

2. An exercise device as in claim 1 wherein the base has an outside perimeter which is generally rectangular in shape and lies in a plane which is normal to the plane defined by the first upright leg and the second upright leg.

3. An exercise device as in claim 1 wherein the base has a first mass and the first upright leg and second upright leg have a second mass, wherein the first mass is greater than the second mass.

4. An exercise device as in claim 1 wherein the first platform portion extends away from the plane defined by the first upright leg and the second upright leg a first distance and the second platform portion extends away from the plane defined by the first upright leg and the second upright leg a second distance, wherein the first distance is greater than the second distance.

5. An exercise device as in claim 1 wherein the base is formed from PVC pipe having a diameter in the range of from about 1 inch to about 4 inches, said base having a width in the range of from about 11 inches to about 20 inches and a length in the range of from about 16 inches to about 24 inches.

6. An exercise device as in claim 1 wherein the base comprises a first pipe section having a first end and a second end, a second pipe section having a first end and a second end, a third pipe section having a first end and a second end, a fourth pipe section having a first end and a second end, a fifth pipe section having a first end and a second end, a sixth pipe section having a first end and a second end, wherein said first end of said first pipe section is connected to said first end of said second pipe section by a first elbow connector, and wherein said second end of said first pipe section is connected to said second end of said fourth pipe section by a second elbow connector and said first end of said third pipe section is connected to said first end of said sixth pipe section by a third elbow connector and said second end of said third pipe section is connected to said first end of said fifth pipe section by a fourth elbow connector, wherein said second end of said second pipe section is connected to said second end of said sixth pipe section by a first T-connector extending generally normal from said base and said first end of said fourth pipe section is connected to said second end of said fifth pipe section by a second T-connector extending generally normal from said base, said first upright leg has a first end and a second end, and said second upright leg has a first end and a second end, and a cross bar having a first end and a second end, wherein the first end of the first upright leg is connected to the first end of the cross bar by a fifth elbow connector, and the second end of said cross bar is connected to the first end of the second upright leg by a sixth elbow connector;

wherein the second end of the first upright leg is connected to the base by the first T-connector and the second end of the second upright leg is connected to the base by the second T-connector.

7. An exercise device as in claim 1 wherein the base has a width of 12 inches and a length of 18 inches.

8. An exercise device as in claim 1 wherein the first upright leg and the second upright leg are between 18 and 22 inches high.

9. An exercise device as in claim 1 wherein the first upright leg has a first end and a second end and the second upright leg has a first end and a second end, wherein the first end of the first upright leg is connected to the first end of the second upright leg by a cross bar positioned generally normal to the upright legs and generally parallel to the base.

10. An exercise device as in claim 1, wherein said device is fabricated from a material selected from the group consisting of metal, wood, graphite composite, laminated wood, and laminated metal.

11. An exercise device as in claim 1, further comprising a pigment deposited on the outer surface of the exercise device.

12. A method for assembling an exercise device said method comprising providing a first upright leg, a second upright leg, and a base, wherein each of the first leg and the second leg has a longitudinal axis, said base having a first side and a second side and having a first means for receiving the first upright leg positioned on the first side and a second means for receiving the second upright leg positioned on the first side, wherein the first upright leg and the second upright leg form a plurality of longitudinally spaced open slots 18 for positioning a rod extending between the first upright leg and the second upright leg, with the slots in each upright leg being aligned in longitudinally spaced pairs, with each pair including one slot in one of the upright legs, and another transversely aligned slot in the other of the upright legs, said base having a first platform portion and a second platform portion wherein said first platform portion extends away from the first means for receiving the first upright leg and the second means for receiving the second upright leg in a first direction and said second platform portion extends away from the first means for receiving the first upright leg and the second means for receiving the second upright leg in an opposite direction, positioning said first upright leg in said first means for receiving said first upright leg and positioning said second upright leg in said second means for receiving said second upright leg on said base in a plane normal to said base, wherein a longitudinal axis lies between said first upright leg and said second upright leg and the first upright leg and the second upright leg lie in a plane parallel to one another.

13. A method for assembling an exercise device as in claim 12 wherein the base has an outside perimeter which is generally rectangular in shape and lies in a plane which is normal to the plane defined by the first upright leg and the second upright leg.

14. A method for assembling an exercise device as in claim 12 wherein the first platform portion extends away from the plane defined by the first upright leg and the second upright leg a first distance and the second platform portion extends away from the plane defined by the first upright leg and the second upright leg a second distance, wherein the first distance is greater than the second distance.

15. A method for assembling an exercise device as in claim 12 wherein the base is formed from PVC pipe having a diameter in the range of from about 1 inch to about 4 inches, said base having a width in the range of from about 11 inches to about 20 inches and a length in the range of from about 16 inches to about 24 inches.

16. A method for assembling an exercise device as in claim 12 wherein the base has a width of 12 inches and a length of 18 inches.

17. A method for assembling an exercise device as in claim 12 wherein the upright legs are between 18 and 22 inches high.

18. A method for exercising, said method comprising providing an exercise device said exercise device having a first upright leg, a second upright leg, and a base wherein the first upright leg and the second upright leg are attached to said base and said base is positioned generally normal to the first upright leg and the second upright leg, wherein a longitudinal axis lies between the first upright leg and the second upright leg and the first upright leg and the second upright leg lie in a plane parallel to one another, wherein the first upright leg and the second upright leg form a plurality of longitudinally spaced open slots for positioning a rod extending between the first upright leg and the second upright leg, with the slots in each upright leg being aligned in longitudinally spaced pairs, with each pair including one slot in one of the upright legs, and another transversely aligned slot in the other of the upright legs, said base having a first platform portion and a second platform portion wherein said first portion extends away from the first upright leg and the second upright leg in a first direction and said second portion extends away from the first upright leg and the second upright leg in an opposite direction, placing said exercise device on a table, providing an exercise bar, wherein said exercise bar is generally cylindrical, placing the exercise bar in a first slot in the first upright leg and the transversely aligned slot in the second upright leg, moving the exercise bar from the first slot in the first upright leg to a second slot in the first upright leg and the transversely aligned slot in the second upright leg.

19. A method for exercising as in claim 18, wherein said exercise bar is weighted internally.

20. An exercise device as in claim 18 wherein the base has an outside perimeter which is generally rectangular in shape and lies in a plane which is normal to the plane defined by the first upright leg and the second upright leg.

21. An exercise device as in claim 18 wherein the first platform portion extends away from the plane defined by the first upright leg and the second upright leg a first distance and the second platform portion extends away from the plane defined by the first upright leg and the second upright leg a second distance, wherein the first distance is greater than the second distance.

22. A method for exercising as in claim 18 wherein the base is formed from PVC pipe having a diameter in the range of from about 1 inch to about 4 inches, said base having a width in the range of from about 11 inches to about 20 inches and a length in the range of from about 16 inches to about 24 inches.

* * * * *